United States Patent [19]

Sugita

[11] Patent Number: 4,877,462

[45] Date of Patent: Oct. 31, 1989

[54] PROCESS FOR PRODUCING OIL QUENCH HARDENING AND TEMPERING AND HARD DRAWN STEEL WIRE OF SHAPED SECTION

[75] Inventor: Heiji Sugita, Tokyo, Japan

[73] Assignee: Sugita Wire Mfg. Co., Ltd., Tokyo, Japan

[21] Appl. No.: 217,494

[22] Filed: Jul. 7, 1988

[30] Foreign Application Priority Data

Jul. 10, 1987 [JP] Japan ..... 62-172372

[51] Int. Cl.[4] ..... C22C 8/06

[52] U.S. Cl. ..... 148/12 B; 148/12 F

[58] Field of Search ..... 148/12 B, 908, 12 F; 428/587

[56] References Cited

U.S. PATENT DOCUMENTS 2,998,336 8/1961 Nachtman ..... 148/12 B 4,568,394 2/1986 Cassell ..... 148/12 B

FOREIGN PATENT DOCUMENTS 241488 9/1971 U.S.S.R. ..... 148/12 B

OTHER PUBLICATIONS

ASM, "Phosphate Coating", *Metals Handbook,* pp. 732–734, 1948 Edition.

*Primary Examiner*—Deborah Yee

*Attorney, Agent, or Firm*—Armstrong, Nikaido, Marmelstein, Kubovcik & Murray

[57] ABSTRACT

There is provided an oil tempered and hard drawn steel wire for springs which comprises having a phosphate coating on the surface thereof if necessary, high strength, and a shaped cross section free of twist in the longitudinal direction. It is produced by oil tempering, descaling, and phosphate treatment if necessary, and cold working. Having a shaped cross section free of twist in the longitudinal direction, the steel wire can be formed into high quality springs in which the individual cross sections of the wire are arranged regularly in the same direction. The steel wire is particularly suitable for making springs.

8 Claims, 1 Drawing Sheet

PROCESS FOR PRODUCING OIL QUENCH HARDENING AND TEMPERING AND HARD DRAWN STEEL WIRE OF SHAPED SECTION

BACKGROUND OF THE INVENTION

1. Field of the Invention

The present invention relates to a technology for producing oil quench hardening and tempering and hard drawn steel wire (oil tempered hard drawn steel wire) having a shaped cross section. More particularly, it relates to oil tempered and hard drawn steel wire which can be easily coiled for the production of springs having superior characteristics, and also to a process for producing the same.

2. Description of the Prior Art

The wire used to make oil springs usually has a round cross section; however, one having an oval cross section, trapezoidal cross section, or any other shaped cross section is desirable for springs used under severe conditions. Although recent coil springs need to meet stringent requirements and to have high quality, it is impossible to make such coil springs from conventional wire having a round cross section. Consequently, studies are being made on oil tempered steel wire having a shaped cross section, and it has been put to practical use in some special fields.

Oil tempered round steel wire is usually produced from hot rolled wire rod by the steps of pickling, annealing, pickling again, cold working (to form the round cross section), and oil tempering. It is noted that the cold working such as wire drawing to make the shaped cross section is performed between the steps of the pickling (descaling) after annealing and the oil tempering.

A disadvantage of this process is that the steel wire is slightly twisted after oil tempering because of unbalanced cold working stress and quenching stress. Such twisted steel wire cannot be coiled into a spring having a normal form. Forced coiling with a jig breaks the wire. Springs made from twisted steel wire are subject to uneven stress distribution, insufficient compressive deflection, and early fatigue failure. They do not meet the design requirements, and yet they are poor in quality and yields.

Another disadvantage of oil tempered steel wire is that it is subjected to more surface flaws than round steel wire because it is coiled while it still has scale formed by heat treatment. In addition, it needs a coiling jig that requires complicated maintenance. For reasons mentioned above, oil tempered steel wire having a shaped cross section is used only in special fields.

SUMMARY OF THE INVENTION

It is an object of the present invention to provide oil tempered and hard drawn steel wire having a shaped cross section free from twisting in the longitudinal direction, which can be formed into springs by easy coiling.

It is another object of the present invention to provide a process for producing economically oil tempered and hard drawn steel wire having a shaped cross section free of twist in the longitudinal direction, which can be easily coiled.

The present inventors carried out extensive studies to overcome the disadvantage of the conventional technology wherein oil tempered steel wire is twisted on account of unbalanced cold working stress, and quenching stress if the wire undergoes oil tempering after it has been given the shaped cross section by cold working. As the result, it was found that oil tempered steel wire can be coiled free of twist if the wire is passed through a die (for cold working) after oil tempering, because the unbalanced quenching stress, if exists, does not affect the shaped cross section formed by cold working.

According to this process, the oil tempered steel wire undergoes coiling while it still has scale resulting from heat treatment. This coiling operation wears the coiling jig and causes flaws to the wire surface. To solve this problem, the present inventors carried out descaling (including phosphate treatment) after the oil tempering. As the result, it was found that this process can be performed for the wire in coiled state. The present invention is based on this finding.

The gist of the present invention resides in oil tempered and hard drawn steel wire for springs having a shaped cross section, a phosphate coating on the surface thereof if necessary, and high strength resulting from oil tempering and cold working (hard drawing) that follows phosphate treatment if necessary, said shaped cross section being free of twist in the longitudinal direction.

According to the present invention, the oil tempered and hard drawn steel wire for springs is produced by the process which comprises descaling, annealing, and descaling again a hot rolled wire rod, cold working the wire rod, oil tempering the cold worked wire, descaling the oil tempered wire, subjecting the oil tempered wire to phosphate treatment if necessary, and cold working the treated wire to give the shaped cross section. The resulting steel wire has a shaped cross section and phosphate coating on the surface thereof if necessary, said shaped cross section being free of twist in the longitudinal direction.

BRIEF DESCRIPTION OF THE DRAWINGS

FIG. 1 shows a cross section of a coil spring in which the individual shaped cross section of the oil tempered steel wire are arranged in the same direction.

FIGS. 2 and 3 each shows a cross section of a coil spring in which the individual shaped cross sections of the oil tempered steel wire are not arranged in the same direction.

DETAILED DESCRIPTION OF THE INVENTION

The steel wire pertaining to the present invention may be made of any kind of steel for coil springs. Examples of the steel include plain carbon steel, Si-Mn steel, Mn-Cr steel, Cr-V steel, Mn-Cr-B steel, Si-Cr steel, and Cr-Mo steel.

The process of the invention starts with hot rolling of a steel ingot into a wire rod. The wire rod undergoes pickling (for descaling), annealing, and descaling again. The descaled wire rod is drawn by cold working into raw steel wire of desired gauge. The steel wire undergoes oil tempering. The oil tempered steel wire undergoes descaling by mechanical means or pickling. The descaled steel wire preferably undergoes phosphate treatment in coiled state if necessary. Thus there is obtained oil tempered steel wire having a phosphate coating of desired thickness.

The oil tempering and descaling may be carried out under the ordinary conditions. The pickling in coiled state should be preferably performed after the removal of bending stress. The phosphate treatment may be carried out by dipping the steel wire in an acid phosphate solution for a prescribed period of time. The insoluble protective coating formed by a phosphate treatment should preferably have a thickness of 5 to 10 g/m$^2$.

After the descaling or phosphate treatment thereafter, the raw steel wire undergoes cold working (such as drawing) to form the shaped cross section as desired. In this way there is obtained hard drawn steel wire having shaped cross section. The thus obtained oil tempered steel wire has higher strength than the conventional one.

The oil tempered steel wire is coiled into a spring of any design, followed by low temperature annealing. Thus there is obtained a spring of oil tempered and hard drawn steel wire having a shaped cross section. The low temperature annealing (bluing) is intended to increase the elastic limit and yield strength which are important spring characteristics. It may be carried out under the ordinary conditions for conventional spring steel wire.

Figure 1:
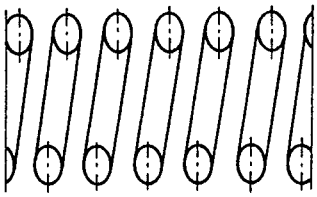
FIGS. 1 to 3 are schematic representations illustrating the shaped cross section of the oil tempered steel wire formed into a coil spring.
Figure 2:
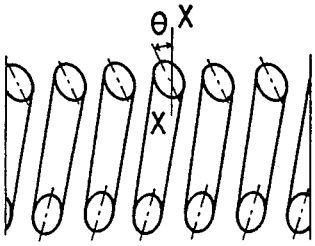
Figure 3:
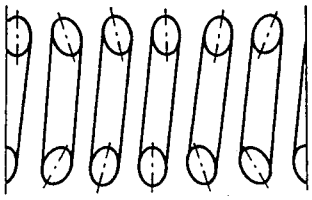

The thus obtained oil tempered and hard drawn steel wire having a shaped cross section (e.g., oval cross section) can be regularly coiled, with the individual cross sections of the wire arranged in the same direction as shown in FIG. 1. There are no instances as shown in FIGS. 2 and 3 in which the individual cross sections of the wire are arranged in different directions. (Incidentally, the chain line in FIGS. 1 to 3 indicates the center line of the shaped cross section.)

BEST MODE CARRYING OUT THE INVENTION

The invention will be described with reference to the following examples.

EXAMPLE 1

A piece of steel having the chemical composition as shown in Table 1 was made into a rod 9.0 mm in diameter by hot rolling. After pickling, the rod was drawn into a wire 7.6 mm in diameter. The wire underwent oil tempering (hardening at 920° C. for 5 minutes and tempering at 450° C. for 2 minutes). The oil tempered wire was wound in coil. The oil tempered wire in coiled state underwent pickling by dipping in 15% hydrochloric acid for 15 minutes.

Figure 4:
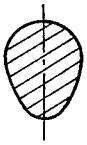
FIG. 4 is a sectional view showing an oval cross section.

The treated wire was drawn into a wire having an oval cross section, 6.0 mm by 7.2 mm, as shown in FIG. 4. The wire was formed into a compressive coil spring, which subsequently underwent low temperature annealing (at 400° C. for 20 minutes).

Table 2 shows the mechanical properties of the oil tempered steel wire, the oil tempered and hard drawn steel wire having a shaped cross section, and the oil tempered and hard drawn steel wire after low temperature annealing obtained in the above-mentioned steps. It is noted from Table 2 that the oil tempered and hard drawn steel wire having a shaped cross section obtained according to the process of the present invention has characteristic properties suitable for springs.

The thus obtained spring was examined for the arrangement of the cross sections. It was found that all the cross sections are arranged virtually in the same direction. (The angle $\theta$ shown in FIG. 2 was smaller than 5 degrees).

TABLE 1

| Chemical Composition (wt %) | | | | | | | |
|---|---|---|---|---|---|---|---|
| C | Si | Mn | P | S | Cu | Ni | Cr |
| 0.55 | 1.40 | 0.72 | 0.012 | 0.008 | 0.01 | 0.01 | 0.72 |

TABLE 2

| Mechanical Properties | | | |
|---|---|---|---|
| Properties | Oil tempered steel wire (7.6 mm) | Oil tempered and hard drawn steel wire of shaped section (6.0 mm, 7.2 mm) | Oil tempered and hard drawn steel wire of shaped section after low temperature annealing |
| Tensile strength (kgf/mm$^2$) | 177 | 198 | 191 |
| Elastic limit (kgf/mm$^2$) | 161 | 141 | 174 |
| Yield strength (kgf/mm$^2$) | 168 | 178 | 186 |
| Elastic limit ratio (%) | 91.0 | 71.2 | 92.1 |
| Yield strength ratio (%) | 94.9 | 89.9 | 97.4 |
| Elongation (%) | 3.5 | 2.0 | 2.5 |
| Reduction of Area (%) | 53 | 47 | 50 |

EXAMPLE 2

A piece of steel having the chemical composition as shown in Table 1 was made into a rod 9.0 mm in diameter by hot rolling. After pickling, the rod was drawn into a wire 7.6 mm in diameter. The wire underwent oil tempering (hardening at 920° C. for 5 minutes and tempering at 450° C. for 2 minutes). The oil tempered wire was wound in coil. The oil tempered wire in coiled state underwent pickling by dipping in 15% hydrochloric acid for 15 minutes, and then underwent phosphate treatment with a total acidity of 30 point, at 80° C. for 7 minutes (the coating weight was 5 to 10 g/m$^2$).

The treated wire was drawn into a wire having an oval cross section, 6.0 mm by 7.2 mm, as shown in FIG. 4. The wire was formed into a compressive coil spring, which subsequently underwent low temperature annealing (at 400° C. for 20 minutes).

Table 3 shows the mechanical properties of the oil tempered steel wire, the oil tempered and hard drawn steel wire having a shaped cross section, and the oil tempered and hard drawn steel wire after low temperature annealing obtained in the above-mentioned steps. It is noted from Table 3 that the oil tempered and hard drawn steel wire having a shaped cross section obtained according to the process of the present invention has characteristic properties suitable for springs.

The thus obtained spring was examined for the arrangement of the cross sections. It was found that all the cross sections are arranged virtually in the same direction. (The angle $\theta$ shown in FIG. 2 was smaller than 5 degrees.)

Although silicon-chromium steel was used in this example, any other spring steels (JIS G4801) can be used in the present invention. The shpaed cross section is not limited to oval, but it can be trapezoidal or whatsoever to produce the same effect.

TABLE 3

| Properties | Mechanical Properties: Oil tempered steel wire (7.6 mm) | Oil tempered and hard drawn steel wire of shaped section (6.0 mm, 7.2 mm) | Oil tempered and hard drawn steel wire of shaped section after low temperature annealing |
|---|---|---|---|
| Tensile strength (kgf/mm$^2$) | 177 | 200 | 192 |
| Elastic limit (kgf/mm$^2$) | 161 | 142 | 174 |
| Yield strength (kgf/mm$^2$) | 168 | 176 | 185 |
| Elastic limit ratio (%) | 91.0 | 71.0 | 90.6 |
| Yield strength ratio (%) | 94.9 | 88.0 | 96.4 |
| Elongation (%) | 3.5 | 2.0 | 2.5 |
| Reduction of Area (%) | 53 | 48 | 50 |

INDUSTRIAL APPLICABILITY

As mentioned above, the present invention eliminated the twisting of the oil tempered steel wire having a shaped cross section by performing oil tempering, descaling, phosphate treatment if necessary, cold working, and coiling. The oil tempered and hard drawn steel wire of shaped section produced according to the invention has a higher strength that the conventional one and can be formed into high quality springs is which the individual cross sections of the wire are arraged regularly in the same direction.

The oil tempered steel wire produced by the process of the present invention can be easily made into springs without complex difficult operations (such as removing twist) regardless of the oval, trapezoidal, or any other cross section. This contributes to the production of flawless springs, the improved productivity and high yields, and the reduction of production cost. Thus the present invention makes it possible to economically produce high-quality coil springs from steel wire having a shaped cross section.

I claim:

1. A process for producing an oil tempered and hard drawn steel wire for springs having a shaped cross section free of twist in the longitudinal direction, which comprises descaling, annealing and descaling again a hot rolled wire rod, cold working the wire rod, oil tempering the cold worked wire, descaling the oil tempered wire, and giving the wire a shaped cross section free of twist in the longitudinal direction by cold working the treated wire.

2. A process for producing an oil tempered and hard drawn steel wire for springs having a shaped cross section free of twist in the longitudinal direction and a phosphate coating on the surface thereof, which comprises descaling, annealing, and descaling again a hot rolled wire rod, cold working the wire rod, oil tempering the cold worked wire, descaling the oil tempered wire, subjecting the oil tempered wire to phosphate treatment, and giving the wire a shaped cross section free of twist in the longitudinal direction by cold working the treated wire.

3. A process as claimed in claim 2 wherein the oil tempered and hard drawn steel wire has a phosphate coating in a weight of 5 to 10 g/m$^2$.

4. A process as claimed in claim 1 or 2 wherein the descaling after the oil tempering is carried out by mechanical means or pickling.

5. A process as claimed in claim 4 wherein the pickling is carried out in a coiled state after the removal of bending stress.

6. A process as claimed in claim 1 or 2 wherein the step of cold working the treated wire to form the shaped cross section is followed by coiling and low temperature annealing.

7. A process as claimed 6 wherein coiling is performed to give coil springs.

8. A process as claimed in claim 1 or 2 wherein the steel wire is produced from steel selected from the group consisting of carbon steel, Si-Mn steel, Mn-Cr steel, Cr-V steel, Mn-Cr-B steel, Si-Cr steel, and Cr-Mo steel.

* * * * *